US008136889B2

(12) United States Patent
Kwon et al.

(10) Patent No.: US 8,136,889 B2
(45) Date of Patent: Mar. 20, 2012

(54) NEEDLE-SHAPED BRISTLE AND METHOD OF MANUFACTURING THE SAME

(75) Inventors: Young-Jun Kwon, Gyunggi-do (KR); Sung-Wook Kwon, Seoul (KR); Sung-Hwan Kwon, Seoul (KR)

(73) Assignee: Best Whasung Co., Ltd., Paju, Gyunngi-Do (KR)

( * ) Notice: Subject to any disclaimer, the term of this patent is extended or adjusted under 35 U.S.C. 154(b) by 924 days.

(21) Appl. No.: 12/096,787

(22) PCT Filed: Dec. 4, 2006

(86) PCT No.: PCT/KR2006/005170

§ 371 (c)(1),
(2), (4) Date: Jul. 8, 2008

(87) PCT Pub. No.: WO2007/073045

PCT Pub. Date: Jun. 8, 2007

(65) Prior Publication Data

US 2008/0289131 A1 Nov. 27, 2008

(30) Foreign Application Priority Data

Dec. 22, 2005 (KR) ..... 10-2005-0127952

(51) Int. Cl.
*A46B 9/04* (2006.01)

(52) U.S. Cl. ..... 300/21

(58) Field of Classification Search ..... 15/207.2, 15/167.1; 300/21

See application file for complete search history.

(56) References Cited

U.S. PATENT DOCUMENTS 6,088,869 A * 7/2000 Kaneda et al. ..... 15/167.1
2004/0103492 A1 * 6/2004 Kwon et al. ..... 15/167.1

FOREIGN PATENT DOCUMENTS

JP 2000-279230 * 10/2000
JP 2000-296024 * 10/2000
JP 2002-172023 * 6/2002
JP 2002-330824 * 11/2002

OTHER PUBLICATIONS

English machine translation of JP 2002-330824, Nov. 2002, Kobayashi.*

* cited by examiner

*Primary Examiner* — Laura C Guidotti
(74) *Attorney, Agent, or Firm* — Egbert Law Offices PLLC

(57) ABSTRACT

The present invention provides a needle-shaped bristle and a method of manufacturing the needle-shaped bristle. The manufacturing method of the present invention includes the steps of cutting and removing a packing sheet, which is wound around a bundle of bristles, by a length ranging from 30 mm to 50 mm from a first end thereof, and grinding first ends of the bristles using a rotating grinder. The manufacturing method further includes steps of packing the first end of the bundle of bristles, from which the packing sheet is removed, using a packing sheet, cutting the bundle of bristles to a length ranging from 22 mm to 32 mm, and immersing a second end of the cut bundle of bristles, thus tapering second ends of the bristles. The needle-shaped bristle has an advantage of realizing a reduction in the proportion of defective products.

6 Claims, 2 Drawing Sheets

[Fig. 1]
PRIOR ART
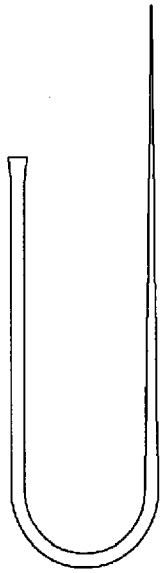
[Fig. 2]
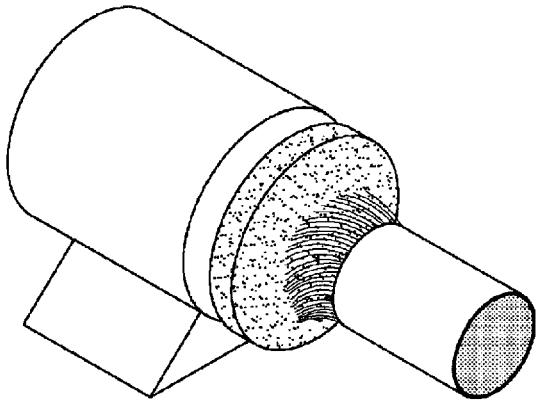
[Fig. 3]
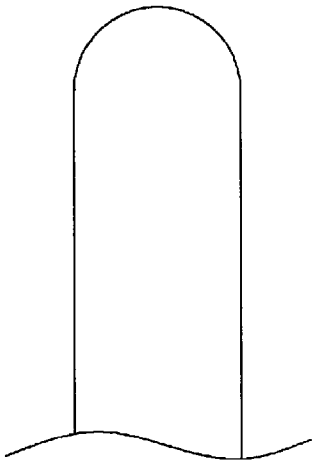

[Fig. 4]
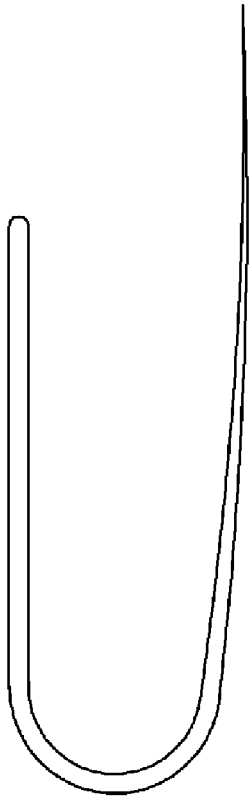

NEEDLE-SHAPED BRISTLE AND METHOD OF MANUFACTURING THE SAME

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates, in general, to needle-shaped bristles and methods of manufacturing the needle-shaped bristles and, more particularly, to a needle-shaped bristle, an end of which is tapered, and the other end of which is ground, and a method of manufacturing the needle-shaped bristle.

2. Description of Related Art Including Information Disclosed Under 37 CFR 1.97 and 37 CFR 1.98

Generally, a needle-shaped bristle is a bristle that is gradually reduced in diameter towards one end. Such a needle-shaped bristle exhibits superior ability to penetrate into gaps between teeth or between teeth and gums, and is soft. Thus, recently, needle-shaped bristles are used in most high-grade toothbrushes.

However, in the case of the needle-shaped bristle, because the end thereof is too soft, the cleaning ability is insufficient compared to a typical bristle. As an example of an attempt to overcome the above disadvantage, there has been a method proposed and used in which a bristle, only one end of which is tapered, is folded in half and set in a head part of a toothbrush such that a tapered end thereof is longer than an untapered end, as shown in FIG. 1. Several techniques related to this were proposed in Japan Utility Model No. Sho. 61-10495 and Korean Patent Registration No. 0464634, which was filed by the inventor of the present invention.

These techniques can mitigate the disadvantages of the needle-shaped bristle, but, because the edge of the cut end, which is not tapered, is sharp, it may injure the gums of a user. In an effort to overcome the above-mentioned problem, a method, in which the end of a bristle is tapered through a chemical treatment process and the other end thereof is also chemically treated for a short time to mitigate the sharpness before the bristle is set in a toothbrush, was proposed in Japan Patent Publication No. Heisei. 2002-192023.

However, this technique has relatively low production efficiency and is problematic in that a chemical treatment process, which creates poor working conditions, must be conducted two times. In addition, in the case of the chemical treatment process, there is a problem in that, if working conditions are changed even slightly, defective products are easily created. For these reasons, the above-mentioned method has not been widely used. In Korea, only the method shown in FIG. 1, in which a bristle, one end of which is tapered, and the other end of which is not tapered, is folded in half and is set in a toothbrush, has been used.

BRIEF SUMMARY OF THE INVENTION

Technical Problem

Accordingly, the present invention has been made keeping in mind the above problems occurring in the prior art, and an object of the present invention is to provide a needle-shaped bristle, one end of which is tapered, and the other end of which is ground. Another object of the present invention is to provide a method of manufacturing the needle-shaped bristle in which the untapered end of the bristle is mechanically ground, thus increasing the production efficiency and reducing the number of defective products.

Technical Solution

To accomplish the above object, in an aspect, the present invention provides a needle-shaped bristle made of polyester resin and having a length ranging from 22 mm to 32 mm and a diameter ranging from 0.1 mm to 0.2 mm before being tapered. The needle-shaped bristle is tapered at an end thereof such that a tapered portion ranges from 4 mm to 8 mm in length and an end point of the tapered portion ranges from 0.01 mm to 0.03 mm in diameter. Another end of the bristle opposite the tapered end thereof is ground by a mechanical method.

In another aspect, the present invention provides a method of manufacturing needle-shape bristles, comprising: cutting and removing a packing sheet, wound around a bundle of bristles, by a length ranging from 30 mm to 50 mm from a first end thereof, grinding first ends of the bristles using a rotating grinder; packing the first end of the bundle of bristles, from which the packing sheet is removed, using a packing sheet; cutting the bundle of bristles to a length ranging from 22 mm to 32 mm; and immersing a second end of the cut bundle of bristles opposite the ground first end thereof in a chemical, thus tapering second ends of the bristles.

Advantageous Effects

The present invention provides a needle-shaped bristle, one end of which is tapered, and the other end of which is ground, through an efficient method that minimizes the proportion of defective products. The needle-shaped bristle manufactured by the method according to the present invention is set in a head part of a toothbrush such that there is a difference in length between the opposite ends of the bristle, thus enhancing both the penetration ability and the cleaning ability. Furthermore, in the present invention, the shorter end of the needle-shaped bristle is ground, thus preventing the gums of a user from being injured when brushing the teeth.

BRIEF DESCRIPTION OF THE SEVERAL VIEWS OF THE DRAWINGS

FIG. 1 is a front elevation view showing a conventional one-sided needle-shaped bristle, which is in a bent state.

FIG. 2 is a perspective view showing a process of grinding bristles after cutting a portion of a packing sheet.

FIG. 3 is a front elevation view showing the end of a bristle after being ground.

FIG. 4 is a front elevation view showing the bent bristle after being tapered and ground.

DETAILED DESCRIPTION OF THE INVENTION

Hereinafter, the present invention will be described in detail with reference to the attached drawings.

A bundle of bristles for toothbrushes has the shape of a cylinder having a diameter ranging from 50 mm to 55 mm and a length from 1 m to 1.2 m. The bundle of bristles is formed by winding a packing sheet, which is made of paper or plastic, around tens of thousands of bristles. In the conventional art, such a bundle of bristles is cut to a predetermined length and, thereafter, ends of bristles are tapered by chemical treatment one or two times, and the bristles are set in a toothbrush body. The case of conducting a chemical treatment process once is pertinent to a method of manufacturing one-sided needle-shaped bristles, as shown in FIG. 1. The case of conducting a chemical treatment process twice is pertinent to a method of manufacturing two-sided needle-shaped bristles or manufacturing needle-shaped bristles that are tapered on one end thereof and ground on the other end.

However, as described above, the case of conducting a chemical treatment process once is problematic in that the end of the bristle that is not tapered is excessively sharp. Furthermore, the case of conducting the chemical treatment process twice can partially solve the above problem, but has problems in that it is difficult to dissolve the sharp cut portion to a desired level using a chemical, and the process is complex, leading to low production efficiency.

In the present invention, after a portion of the packing sheet has been removed before the bundle of bristles is cut, ends of the bristles are ground using a grinder (see, FIG. 2). Thereafter, a packing sheet is wound around the bundle of bristles, and the bundle of bristles is cut to a desired length. If the bristles are ground without removing the portion of the packing sheet, because the bristles are very dense due to the packing sheet, the bristles cannot be efficiently ground. It is appropriate to remove the packing sheet to a length ranging from 30 mm to 50 mm. If the length to which the packing sheet is removed is less than this range, grinding efficiency is reduced. If the length to which the packing sheet is removed is greater than this range, because the bristles sag, the grinding process cannot be smoothly conducted. In the case where the length to which the packing sheet is removed is within the above-mentioned range, the bristles, which have been dense, are released and separated from each other, as shown in FIG. 2, so that the ends and side surfaces of the bristles can be smoothly ground. As a result, the end of each bristle is rounded, as shown in FIG. 3.

As such, the grinding treatment process uses a method of bringing the ends of the bristles into contact with the rotating grinder. A one-way grinder, which rotates in only one direction, may be used. Alternatively, a grinder, which repeats operations of rotating in one direction for a predetermined time and then rotating in reverse, may be used.

After the grinding process has been completed, the portion of the bundle of bristles, from which the packing sheet has been removed, is again covered with another packing sheet. Thereafter, the bundle of bristles is cut to a desired length. Here, it is preferable that the length to which the bundle of bristles is cut range from 22 mm to 32 mm. As such, because another packing sheet is again wound around the exposed portion of the bundle of bristles, the bristles can be stably supported, so that the cutting process can be easily conducted, and a subsequent chemical treatment process can be efficiently conducted. Furthermore, in the chemical treatment process, only when the bundle of bristles are immersed in an acid or alkali chemical in the state of being covered with the packing sheet can the bristles be tapered appropriately.

The process of chemically treating the cut bundle of bristles is the same as that of the conventional art. The time required for the chemical treatment is adjusted such that tapered portions of the bristles range from 4 mm to 8 mm in length and end points of the tapered portions range from 0.01 mm to 0.03 mm in diameter. In the case where the lengths of the tapered portions of the bristles or the diameters thereof are outside the above range, both penetration ability and cleaning ability are reduced.

When the chemical treatment process is completed, the bristles have tapered shapes on first ends thereof and have ground shapes on second ends thereof. Such bristles are bent, as shown in FIG. 4, and are set in the head part of the toothbrush body. The method of setting the bristles is a method in which each bristle is picked and pushed into a related setting hole, formed in the head part of the toothbrush body, using a wire, in the same manner as in the conventional art.

Preferably, each bristle is bent such that there is a length difference ranging from 1 mm to 4 mm between a longer part and a shorter part thereof. The longer part of the bristle has a tapered end, and the shorter part thereof has a ground end. As such, in the case where the bristles are set such that there is a length difference between opposite ends of each bristle, both the penetration ability and the cleaning ability of the bristles can be increased. The reason for this is that the tapered ends of the longer parts of the bristles can easily penetrate into the gaps between teeth or between the teeth and gums without being impeded by the shorter parts of the bristles and, simultaneously, the shorter parts of the bristles can efficiently clean the surface of the teeth without being impeded by the longer parts of the bristles.

In another embodiment of the present invention, a bundle of bristles is cut to a length ranging from 20 mm to 30 mm, and a packing sheet is removed from the bundle of bristles. The bristles are divided into several groups, and ends of the divided groups of bristles are mechanically ground using a grinder. Subsequently, the bristles are again gathered into the bundle arrangement, and ends of the bristles which are opposite the ground ends are immersed in a chemical, thus being tapered.

In another embodiment of the present invention, a packing sheet is moved with respect to a bundle of bristles and, thereafter, ends of the bristles are ground. Subsequently, the packing sheet is returned to the original position thereof, and the bundle of bristles is cut to a length ranging from 20 mm to 30 mm. Thereafter, ends of the bristles which are opposite the ground ends are immersed in a chemical, thus being tapered.

We claim:

1. A method of manufacturing needle-shaped bristles, the method comprising:

cutting and removing a packing sheet wound around a bundle of bristles by a length of between 20 millimeters and 30 millimeters from a first end thereof;

grinding first ends of the bristles with a rotating grinder;

packing the first end of the bundle of bristles using the packing sheet;

cutting the bundle of bristles to a length of between 22 millimeters and 32 millimeters; and immersing a second end of the cut bundle of bristles opposite the ground first end in a chemical so as to taper the second ends of the bristles.

2. The method of claim 1, the bristles being tapered such that a tapered portion of the bristles have a length of between 4 millimeters and such that an end portion of the bristles has a diameter of between 0.01 millimeters and 0.03 millimeters.

3. A method of manufacturing needle-shaped bristles, the method comprising:

cutting a bundle of bristles to a length of between 20 millimeters and 30 millimeters;

dividing the bristles into a plurality of groups;

grinding first ends of the divided bristles using a grinder;

gathering the bristles into a bundle arrangement; and immersing second ends of the bristles opposite the ground first ends into a chemical so as to taper the second ends of the bristles.

4. The method of claim 3, the bristles being tapered such that a tapered portion of the bristles have a length of between 4 millimeters and such that an end portion of the bristles has a diameter of between 0.01 millimeters and 0.03 millimeters.

5. A method manufacturing needle-shaped bristles, the method comprising:

moving a packing sheet from an original position backwards relative to a bundle of bristles;

grinding first ends of the bristles;

returning the packing sheet to the original position;

cutting the bundle of bristles to a length of between 20 millimeters to 30 millimeters; and immersing second ends of the bristles opposite the ground first ends in a chemical so as to taper the second ends of the bristles.

6. The method of claim 5, the bristles being tapered such that a tapered portion of the bristles have a length of between 4 millimeters and such that an end portion of the bristles has a diameter of between 0.01 millimeters and 0.03 millimeters.

* * * * *